US010408200B2

(12) United States Patent
Liu et al.

(10) Patent No.: US 10,408,200 B2
(45) Date of Patent: Sep. 10, 2019

(54) FLEXIBLE BEAM VERTICAL PUMPING UNIT

(71) Applicants: Yanan Liu, Dongying, Shandong Province (CN); Dawei Wang, Dongying, Shandong Province (CN)

(72) Inventors: Yanan Liu, Dongying, Shandong Province (CN); Dawei Wang, Dongying, Shandong Province (CN)

( * ) Notice: Subject to any disclaimer, the term of this patent is extended or adjusted under 35 U.S.C. 154(b) by 359 days.

(21) Appl. No.: 14/933,419

(22) Filed: Nov. 5, 2015

(65) Prior Publication Data

US 2016/0273323 A1 Sep. 22, 2016

Related U.S. Application Data

(60) Provisional application No. 62/135,300, filed on Mar. 19, 2015.

(51) Int. Cl.

| | |
|---|---|
| ***F04B 9/02*** | (2006.01) |
| ***F04B 17/03*** | (2006.01) |
| ***F04B 47/02*** | (2006.01) |
| ***E21B 43/12*** | (2006.01) |

(52) U.S. Cl.

CPC ..... *F04B 9/02* (2013.01); *E21B 43/126* (2013.01); *F04B 17/03* (2013.01); *F04B 47/02* (2013.01); *F04B 47/028* (2013.01)

(58) Field of Classification Search

CPC ..... F04B 47/02; F04B 49/02; F04B 49/10; F04B 2201/0201; F04B 2201/1211; E21B 43/126

USPC ..... 417/416

See application file for complete search history.

(56) References Cited

U.S. PATENT DOCUMENTS

| | | | | |
|---|---|---|---|---|
| 1,970,596 A * | 8/1934 | Coberly | F04B 47/00 | 74/37 |
| 2,351,183 A * | 6/1944 | Blackburn | F04B 47/02 | 74/37 |
| 3,153,387 A | 10/1964 | Sadouet | | |
| 4,187,680 A * | 2/1980 | Sanford | F04B 47/04 | 60/369 |
| 4,391,155 A * | 7/1983 | Bender | F04B 47/02 | 417/44.1 |
| 4,406,597 A * | 9/1983 | Stanton | E21B 17/07 | 417/399 |

(Continued)

FOREIGN PATENT DOCUMENTS

| | | |
|---|---|---|
| CA | 2580293 | 8/2007 |
| CN | 87213287 U | 5/1988 |

(Continued)

*Primary Examiner* — Waseem Moorad
*Assistant Examiner* — Lamia Quaim
(74) *Attorney, Agent, or Firm* — Dragon Sun Law Firm, P.C.; Jinggao Li, Esq.

(57) ABSTRACT

A vertical pumping unit for pumping oil from a well is disclosed including a vertically oriented frame, an electrically powered motor, a flexible beam connected on a first end to pumping machinery lowered into an oil well hole, a counterweight connected to a second end of the flexible beam and suspended by the frame, and a drum-type deceleration roller cone. The roller cone includes an input shaft receiving torque from the motor, internal reduction machinery, and an output drum translating the flexible beam back and forth to activate a pumping action.

7 Claims, 6 Drawing Sheets

(56) References Cited

U.S. PATENT DOCUMENTS

| | | | | | |
|---|---|---|---|---|---|
| 4,660,426 | A | | 4/1987 | Mosley | |
| 5,820,350 | A | * | 10/1998 | Mantey | E21B 43/126 417/45 |
| 2008/0105422 | A1 | | 5/2008 | Zhang | |
| 2013/0045116 | A1 | * | 2/2013 | Wang | E21B 43/126 417/53 |
| 2013/0058803 | A1 | * | 3/2013 | Mao | E21B 43/126 417/313 |
| 2015/0021010 | A1 | * | 1/2015 | Chaika | F04B 47/14 166/68 |
| 2016/0245276 | A1 | * | 8/2016 | Robison | E21B 43/127 |

FOREIGN PATENT DOCUMENTS

| | | | | | |
|---|---|---|---|---|---|
| CN | 2371367 | Y | | 3/2000 | |
| CN | 1793602 | A | | 6/2006 | |
| CN | 201041017 | Y | | 3/2008 | |
| CN | 101201000 | A | | 6/2008 | |
| CN | 101581206 | B | | 8/2012 | |
| GB | 235002 | A | * | 6/1925 | F04B 19/16 |

* cited by examiner

FLEXIBLE BEAM VERTICAL PUMPING UNIT

CROSS REFERENCE TO RELATED APPLICATIONS

This disclosure claims the benefit of U.S. Provisional Application No. 62/135,300 filed on Mar. 19, 2015 which is hereby incorporated by reference.

TECHNICAL FIELD

This disclosure is related to a unit for pumping oil from the ground. More specifically, the disclosure involves a kind of mechanical equipment of surface oil production in the oil field, especially for a kind of flexible beam deceleration roller cone vertical pumping unit with enhanced long service life, high reliability, and asynchronous motor reversing.

BACKGROUND

The statements in this section merely provide background information related to the present disclosure. Accordingly, such statements are not intended to constitute an admission of prior art.

A pumping unit is a kind of conventional equipment in the oil field. Two exemplary known alternative configurations for pumping units include a beam-pumping unit and a vertical pumping unit.

Beam-pumping units have been widely used throughout the oil industry, which due to its simple structure, long service life, and over one hundred years of use. Beam-pumping units include a beam pivoted near a center, a motor providing power to stroke one side of the beam up and down, and the other side of the beam being attached to pump machinery. Beam-pumping units include low efficiency and high energy consumption operation. Stroke length and stroke frequency tend to be inflexible. Adjusting an output of a beam-pumping unit requires significant adjustments to the unit and the maximum output of the unit can be insufficient to meet large load requirements.

Vertical pumping units have been used in recent years. Vertical pumping units can include mechanical reversing and motor reversing mechanisms. A stroke length of the mechanical reversing mechanism of known mechanisms is fixed and stroke frequency is also difficult to adjust. Known vertical pumping unit configurations cannot adapt to different requirements under various working conditions.

Known vertical pumping units, including mechanical reversing mechanisms, include complicated mechanical structures. Such known mechanical reversing mechanisms, including moving mechanical parts under significant stress, increase maintenance workload.

Mechanical transmissions used in known vertical pumping units are complex. The transmission includes many flexible components and it has poor reliability, reversing radius is small, loaded shocking is large, and failure rates are high. An expected useful life for a vertical pumping unit can be significantly less than an expected useful life for a typical beam-pumping unit. Many vertical pumping units are designed and marketed only to prove to be unusable in the field.

SUMMARY

A vertical pumping unit for pumping oil from a well is disclosed to include a vertically oriented frame, an electrically powered motor, a flexible beam connected on a first end to pumping machinery lowered into an oil well hole, a counterweight connected to a second end of the flexible beam and suspended by the frame, and a drum-type deceleration roller cone. The roller cone includes an input shaft receiving torque from the motor, internal reduction machinery, and an output drum translating the flexible beam back and forth to activate a pumping action.

BRIEF DESCRIPTION OF THE DRAWINGS

One or more embodiments will now be described, by way of example, with reference to the accompanying drawings, in which.

DETAILED DESCRIPTION

Figure 1:
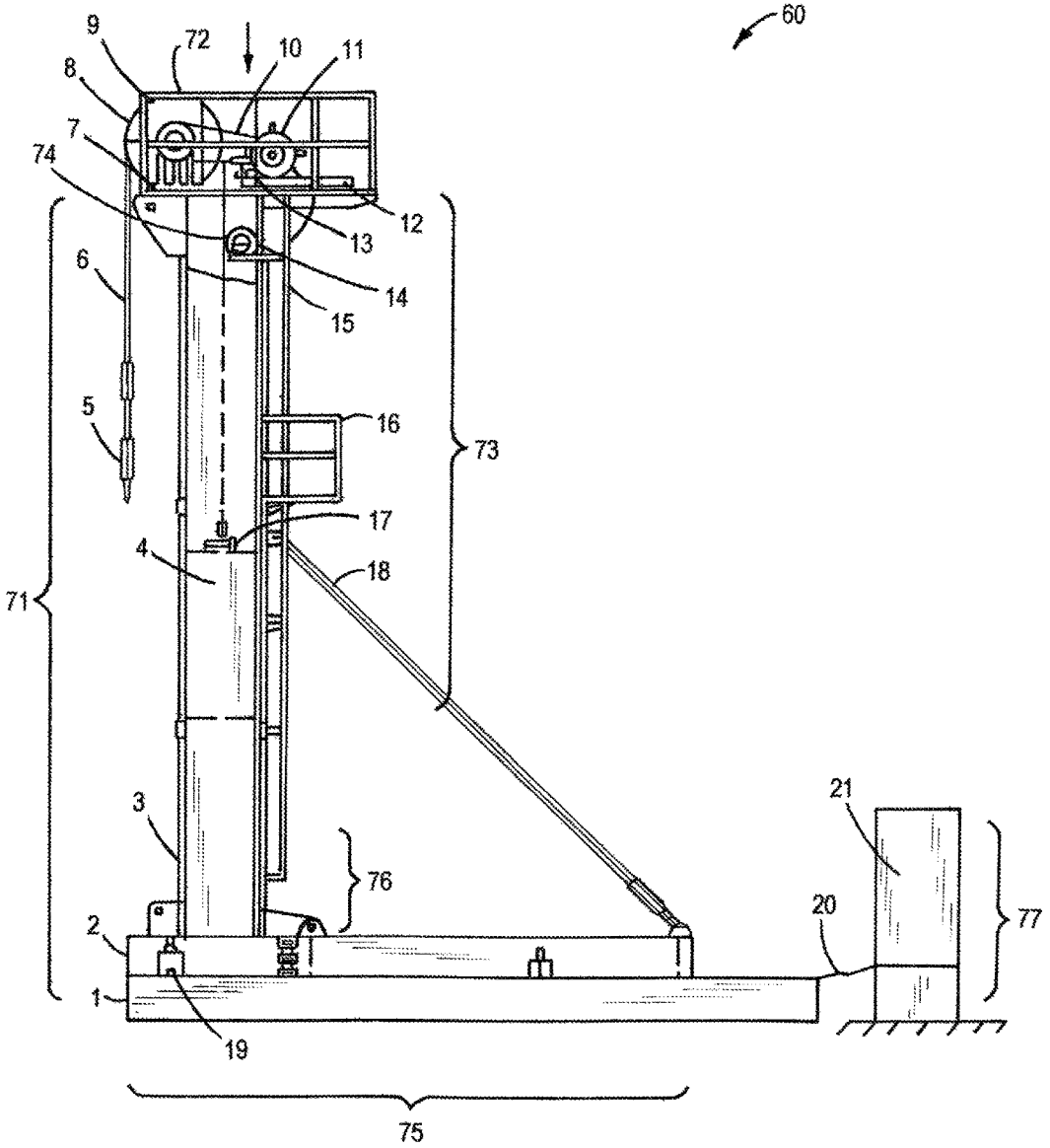
FIG. 1 illustrates a schematic of a side view of an exemplary flexible beam deceleration roller cone vertical pumping unit, in accordance with the present disclosure.

The disclosed pumping unit provides a flexible beam deceleration roller cone vertical pumping unit including long service life, high reliability, and asynchronous motor reversing. The pumping unit includes a simple structure, convenient adjustment of pumping parameters, a long service life, and can be used in a wide variety of scales of applications.

An exemplary pumping unit according to the disclosure includes a kind of flexible beam deceleration roller cone vertical pumping unit, which includes a moving cement base, a frame, a counterweight box, an oriented reducing power and anti-fall device of counterweight box, a beam hanger, a load leather belt, a deceleration roller cone, a motor, a joint zone belt connecting the motor to an input shaft of the deceleration roller cone, a calibration zero proximity switch, an unloading lifting cylinder assembly and cable, a moving machine and abdicating lifting wheel, a dynamic assembly of electric leading screw, and an electric control cabinet. The electric control cabinet controls speed, direction, and reversing commands of the motor on the platform in additional to controlling the deceleration roller cone mechanism and providing controlling commands to the deceleration roller cone. For example, providing variable gear reduction or changing a ratio of angular velocity of a spinning input shaft to a spinning output drum driving the load leather belt resting upon the output drum. Movement of the output drum through forward and reverse rotation provides back and forth movement of the load leather belt which in turn drives up and down movement of the counterweight box and the down-hole load. Variable control of the motor and the deceleration roller cone mechanism provides previously unrealized digital control of stroke and stroke frequency of the pumping unit. In addition, the disclosed pumping unit has a number of additional distinct features which are described in detail herein.

An exemplary frame assembly includes a base, a frame, and upon the frame there is an upper platform and platform guardrail. The side of the frame can include a ladder for an operator to ascend to maintain the machinery on top of the unit. The frame assembly can further include a stabilization regulating support bar. The driving assembly of the motor and the deceleration roller cone connected by the joint zone belt is installed on the upper platform upon the frame. The counterweight box, which connects with the guide rail, is configured to travel up and down within an internal portion of the frame. A flexible balance beam or leather belt suspension balance assembly includes a beam hanger, a loading belt, a deceleration roller cone, and a counterweight box. The loading belt rests upon an a roller cone or output drum forming the outer surface of the deceleration roller cone. The friction between the belt and the output drum is used to transform the circular motions of the output drum into the linear motion of the load leather belt. Positive and negative rotation of the motor drives positive and negative rotation of the deceleration roller cone and the output drum. Rotation of the deceleration roller cone causes the load leather belt to undergo reciprocating movement up and down. This up and down movement is used to meet the requirements of the reciprocating linear motion of underground machinery used to pump oil to the surface (e.g. a subsurface oil pump.)

The flexible balance beam includes a loading belt. The loading belt can take a number of forms. In one exemplary embodiment, the loading belt is a leather or composite leather belt. In another embodiment, the loading belt is a wide fiber layer rubber belt. The front of the load leather belt connects the beam hanger and a lug connects the counterweight box. In order to provide electronic control of the moving belt a central location of the belt can include a calibration zero proximity soft iron or a metallic attachment configured to be sensed by a proximity sensor or sensors. Hoisting lugs can be installed upon the counterweight box to enable a small motor to aid in moving the box to a desired location such as a desired starting location when the unit is being first turned on. The counterweight box includes weights. For example, the box can include cast iron blocks for weighing the balance. In one embodiment, the counterweight box can be adjustable depending upon the specifics of the underground oil pumping machinery.

The motor used in the disclosed pumping unit can include an asynchronous motor. Electronic or digital control can be used to vary control parameters for the pumping unit through the asynchronous motor. Various control methods can be utilized including programmable logic controller (PLC), remote terminal unit (RTU), digital signal processing (DSP), or a microcomputer control frequency converter and field oriented control technology, or the direct torque control technology of the frequency converter. Such a control method can control the torque, power, and efficiency of the asynchronous alternating current motor through a wide speed range. Such control has stable and reliable performance, can frequently reverse, can freely adjust stroke, and stroke frequency as well as utilizing different speeds of the up and down stroke. Further, such electronic control enables remote monitoring and control of the operating parameters and the indicator diagram of the pumping unit through computerized control over a communications network.

The electronic control cabinet includes a computerized controller. For example, the controller can include a processor, random-access memory, and durable memory such as is provided by a hard drive unit. The processor is configured to operate through computerized code or programming. Such programming can be configured to operate in a control module or a series of control modules. Input devices can be used to receive inputs from operators or command centers. Sensors can be located about the pumping unit to provide various parameters such as motor speed, motor direction, roller cone settings, and load upon the loading belt. Control outputs are provided enabling the control modules to control various aspects of operation of the pumping unit. A number of alternative configurations and control strategies utilizing computerized components known in the art are envisioned, and the disclosure is not intended to be limited to the particular exemplary embodiments provided herein.

An exemplary embodiment of the deceleration roller cone includes a drum-type reducer. Such an exemplary reducer can include a roller, left and right end shield, left and right axle shaft and other features of the built-in decelerating machine. Each half shaft is fixed on the two support bases, and the left and right end shield and roller form an output shaft or an output drum. The input axis is inside the half shaft, a joint zone belt wheel and power-off brake are installed on left and right sides of the shaft bearing, the joint zone belt wheel connects to the motor through the joint zone belt, motor, and steering. The drive roller operates in positive and negative rotation. In this way, positive and negative rotation of the motor drives positive and negative rotation of the deceleration roller cone. Deceleration mechanisms can include a planetary cycloidal pin gear speed reducer or a planetary gear speed reducer.

The deceleration roller cone unit accepts a torque input through the input shaft. The input shaft provides torque to reduction machinery such as a planetary gear set, which in turn provides torque to an output shaft such as an output drum. A disclosed embodiment of the deceleration roller cone includes a cylindrically shaped unit, with the output drum forming the cylindrical outer surface of the unit, and with all of the reducing machinery located internally to the unit. Such a unitary design can have a number of advantages. By being totally contained, the unit can have fewer moving parts and a more simple design than a unit with a drum separate from a transmission assembly. Additionally, the unit can be modular which means that as a pumping unit is moved or as pumping load changes for a particular well different sizes of roller cones can be installed. Further, structure used to reinforce the positioning of the planetary gears can further reinforce the drum, meaning that the roller cone unit can be rated for higher belt loads with minimal excess structure.

The unloading and hanging-load assembly described can include a small power hoist. It consists of a motor such as a motor with a power rating of less than 5 kW, a complete set of cycloidal reducers and small diameter roller cone, and a steel wire rope winding on a roller. The small power hoist is attached to an upper portion of the frame. The hoist ability of the small power hoist is larger than the full load weight of the counterweight box. When hanging a load, the device is used to hoist the counterweight box to the top dead center, i.e. lower dead center of the pumping unit. When unloading, the device is used to put the counterweight box down to the frame base. The small power hoist can be used to preset the weight and the flexible beam in a desired position when the primary motor is not operational. For example, during a start-up procedure for the pump unit. Operation of the hoist and the counterweight is not only stable but also safe.

The anti-fall assembly described is a device for reducing power and including an anti-fall device which is installed and oriented inside the frame on the base. The device includes a spring and both ends of the spring are respectively fixed on the upper and lower two steel plates which are on the frame base. The anti-fall assembly translates kinetic energy of the counterweight box into elastic potential energy of the spring, when the counterweight box is depressed and energy is stored in the spring, and the spring translates the elastic potential energy into kinetic energy of the counterweight box when the counterweight box is reversing. The anti-fall assembly aids in the reduction of lost energy in the reversing of the counterweight. Additionally, in the event of loss of control of the counterweight, the spring unit can act to mitigate the impact of the heavy counterweight upon the base of the unit.

According to one advantage of the disclosed pumping unit, an advanced method for controlling the motor is disclosed which enables flexible and efficient reversing of the primary motor. In one exemplary embodiment, the disclosed motor can be controlled by field oriented control technology. The use of a field oriented brushless motor and adjustable reduction mechanism provides for increased flexibility in operation of the pumping unit. For example, a preferred speed for moving the underground pumping machinery in one direction and a second preferred speed for moving the machinery in the second direction can be utilized. Additionally, field oriented control provides advantages over other types of motor control, as is known, such as providing for smooth control of motor speed over a greater range of speeds.

According to another advantage of the disclosed pumping unit, the deceleration roller cone which transforms torque input from the primary motor into linear, reciprocating motion of the flexible beam enables flexible and efficient operation.

According to another advantage of the disclosed pumping unit, the flexible beam constructed of an exemplary pliable band, such as a load leather belt, provides advantages over other configurations utilizing, for example, an industrial chain to provide the translating motion to the underground pumping equipment. In one embodiment, a pliable band is advantageous as compared to a heavy industrial chain in terms of reduced weight. The energy required to physically accelerate a heavy chain back and forth can be extensive. A relatively light but strong beam material that can be accelerated back and forth with less expenditure of energy. Further, a leather and/or rubberized beam can include stretch or flex which can act as a shock absorber when the drive is reversed, reducing jerkiness of the force provided to the underground equipment. Similarly, the flat material of the beam interacting with the surface of the cone device can provide additional controlled slip at the reversals to further reduce the shock transmitted by the beam as the direction of motion is changed. Additionally, in the event of an uncontrolled pressure event underground, for example, caused by an unexpected oil pressure spike, backwards force applied by the underground equipment upon a heavy chain can cause the chain to become a projectile capable of damaging the frame and equipment located atop the frame. A leather or rubberized pliable band is lighter weight and would tend to coil rather than become a projectile, thereby reducing a chance of the uncontrolled pressure event from harming the unit. The disclosure provides leather and rubberized versions of the flexible beam. Any number of flexible or bendable materials or composite constructions can be used to create the flexible beam, and the disclosure is not intended to be limited to the examples provided.

According to another advantage of the disclosed pumping unit, the base of the unit can be situated upon a slab or cement base with mobile features enabling the base to translate or move upon the slab. According to one embodiment of the disclosure, an abdicating lifting wheel is attached to the base which enables a first locked state where the wheel is retracted or locked and the base is firmly set upon the slab. The abdicating lifting wheel further enables a second mobile state where the base and the attached frame can be moved such as retracted back away from the well-head. Such mobility can enable easy access and setup for the workers to maintain the equipment. Further, in the event of a sensed uncontrolled pressure event underground the unit can be either manually or automatically retracted away from the well-head such that the unit and all of the associated equipment are protected from damage from anything being forced out of the well. The abdicating lifting wheels can take any of a number of physical embodiments. According to one embodiment, the wheels can be hydraulically, pneumatically, or mechanically retracted or extended, to enable the two states described above. In one embodiment, one or more of the wheels can be attached to a motor to enable the wheels to provide torque to move the base. In another embodiment, the wheels are free to spin and another motor is attached to the base. The motor provides a force to move the base in relation to the slab.

According to another advantage of the disclosed pumping unit, the small power hoist can be provided upon the frame to aid in lifting the counterweight and setting the pumping unit in a preset position such as for the most advantageous position to starting the unit. The primary motor can efficiently move the flexible beam through its range of motion. However, initially pulling the counterweight up from a dead stop at the bottom of its travel can require a lot of energy. The gearing ratio of the cone unit can be selected to optimally move the already moving counterweight by using the spring force of the anti-fall unit to aid in efficiently moving the counterweight from the lowest position of travel. Use of the small power hoist with the described primary motor and anti-fall unit can enable more efficient operation of the pumping unit thereby avoiding the need to select a gear ratio and primary motor size necessary to lift the counterweight from a dead stop.

According to another advantage of the disclosed pumping unit, as described above, the anti-fall unit provides advantages both in avoiding damage in an uncontrolled fall of the counterweight such as during an uncontrolled pressure event and in aiding the primary motor to reverse a direction of motion and initially lift the counterweight from a lowest position of travel.

A vertical beam pumping unit can advantageously include all six of the aforementioned advantages and corresponding physical features. Such a pumping unit can include a field oriented control for an electric motor, a deceleration roller cone using a drum-type reducer, a load leather belt, an abdicating lifting wheel enabling selective movement of the pumping unit, a small power hoist enabling one to move the counterweight to a desired present position, and a spring loaded anti-fall unit facilitating both return of the counterweight through its lowest travel and protecting the unit from an uncontrolled fall of the counterweight. However, any of these six advantages can be used with prior art pumping units without the other advantages or in combination with selected other advantages. For example, the field oriented control of the motor can be used with an otherwise conventional vertical pumping unit, allowing the user to easily modulate stroke length and frequency of the pumping unit. In another example, one could use conventional motor control with a deceleration roller cone including a drum-type reducer and with a load leather belt and still realize the advantages of those two improvements. Using combinations of the above advantages in combination can provide cooperative advantages. For example, using the field oriented control motor with the anti-fall unit and the small power hoist can permit a smaller primary motor to be used than would otherwise be enabled. The disclosure is intended to include any combination of the described advantages.

Referring now to the drawings, wherein the showings are for the purpose of illustrating certain exemplary embodiments only and not for the purpose of limiting the same, FIG. 1 illustrates a structural schematic of a lateral surface of an exemplary flexible beam deceleration roller cone vertical pumping unit. The flexible beam deceleration roller cone vertical pumping unit 60 includes a frame assembly 71, a deceleration roller cone driving assembly 72, a flexible beam-load leather belt suspension balance assembly 73, an unloading and hanging load assembly 74, a moving machine and abdicating assembly 75, an anti-fall assembly 76, and an electric-controlling system 77. Flexible beam deceleration roller cone vertical pumping unit 60 includes moving machine cement base 1, base 2, frame 3, counterweight box 4, beam hanger 5, load leather belt 6, upper platform 7, deceleration roller cone 8, upper platform guardrail 9, joint zone 10, primary motor 11, fixed guide rail 12 for regulating the motor, calibration zero proximity switch 13, hoisting drum 14, cat ladder 15, middle platform and guardrail 16, hoisting lugs of the counterweight box 17, stabilization regulating support 18, moving machine and abdicating lifting wheel 19, electronic control cable 20, and electric control cabinet 21.

Frame assembly 71 of the flexible beam deceleration roller cone vertical pumping unit 60 includes base 2 and frame 3 situated upon base 2. Frame 3 includes middle platform 16 and upper platform 7. Within frame 3 a fixed rail for counterweight box 29 to translate upon is included. Further, cat ladder 15 can be installed on the side of base 2 to provide workers with access to platforms 7 and 16. Stabilization regulating support 18 is installed between base 2 and frame 3 to provide for mechanical stability of the vertically oriented frame 3. Upper platform 7 includes guardrail 9. A plurality of moving machine and abdicating lifting wheels 19 are installed on the side of base 2 and permit for adjustment of the frame assembly on the moving cement base 1. Anchor bolts are used to secure base 2 to cement base 1. Electric control cabinet 21 is installed behind moving cement base 1 to provide for digital control of unit 60.

Figure 2:
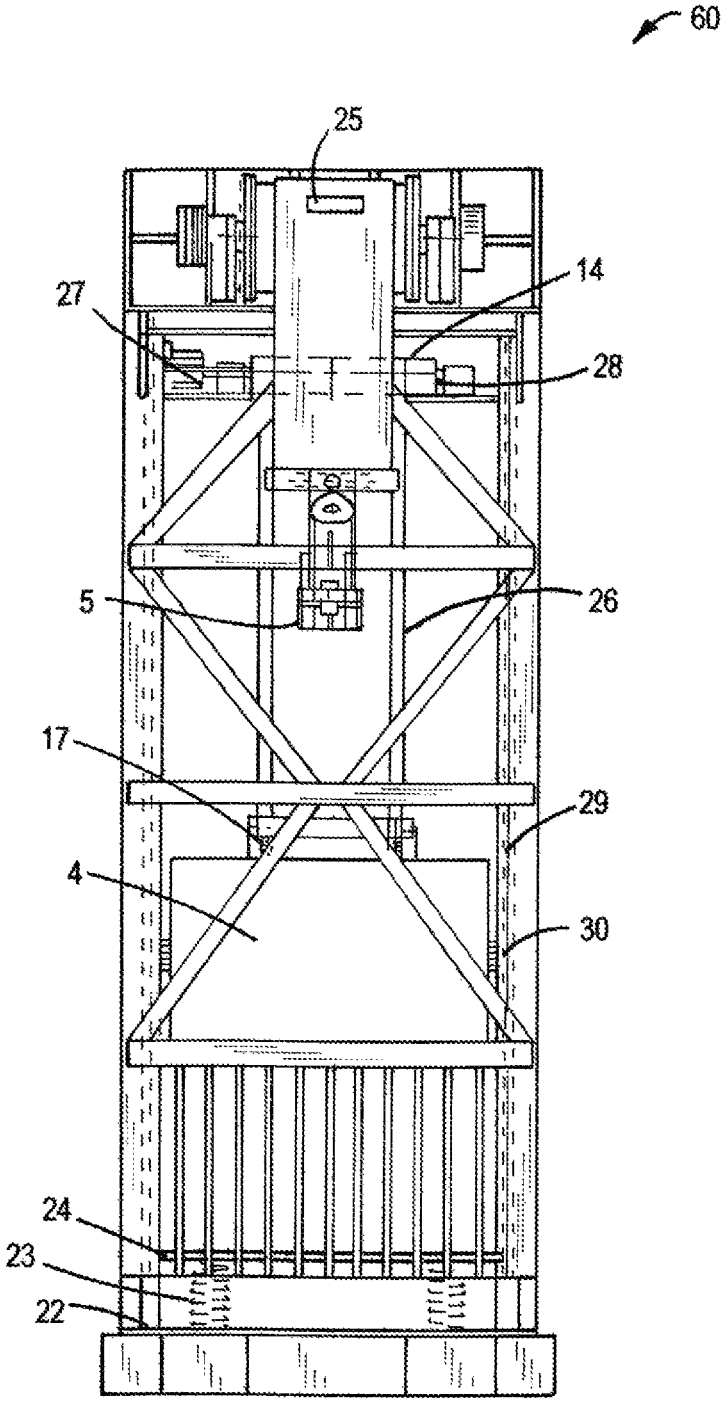
FIG. 2 illustrates a schematic of a front view of the pumping unit of FIG. 1, in accordance with the present disclosure.

FIG. 2 illustrates a structural schematic of the front surface of the pumping unit of FIG. 1. Flexible beam deceleration roller cone vertical pumping unit 60 includes counterweight box 4, beam hanger 5, hoisting drum 14, hoisting lugs of the counterweight box 17, anti-fall lower plate 22, anti-fall spring 23, anti-fall upper plate 24, calibration zero soft iron 25, unloading wire rope 26, hoisting drum power machine 27, hoisting drum base 28, fixed guide rail of the counterweight box 29, and angle sheave of the counterweight box 30. An unloading and hanging-load assembly of the flexible balance beam deceleration roller cone upright beam pumping unit includes hoisting drum 14 installed on frame 3 through the hoisting drum base 28, with hoisting drum power machine 27 installed on the frame and link hoisting drum 14 to supply power to hoisting drum 14. One end of unloading wire rope 26 is fixed on hoisting drum 14 and the other end is fixed on the counterweight box hoisting lug 17 which is installed on the top of counterweight box 4. Workers can remove unloading wire rope 26 to make hoisting drum 14 disconnect with counterweight box hoisting lug 17 when the pumping unit operates normally. When an operation for unloading and hanging-load of the oil well load is needed rope 26 can connect hoisting drum 14 with the counterweight box hoisting lug 17. The system plays a role in that counterweight box 4 is lifted to make the conjunction between the bare trunk of the wellhead side and load leather belt 6 relax and remove the connection between the bare trunk and the load leather belt 6. Workers may then easily remove the bare trunk load connected by the load leather belt 6 beside the wellhead.

A flexible balance beam-load leather belt suspension balance assembly is disclosed for use on a pumping unit. Load leather belt 6, an embodiment of a flexible beam, lays upon and receives torque from the cylindrical outer surface of deceleration roller cone 8. The central location of load leather belt 6 can include calibration zero proximity soft iron 25 or an attached metallic unit that can be sensed by a magneto-metric sensor to provide a count or measurement to the control system when the iron 25 passes the sensor. The front of belt 6 connects to beam hanger 5, the lug of the belt connects to the counterweight box 4, and counterweight box 4 is installed inside the frame 3. Angle sheave 30 is installed on the side of the counterweight box.

An anti-fall assembly includes anti-fall lower plates 22 installed on frame 3 under base 2, anti-fall spring 23 installed on the anti-fall lower plates 22, and anti-fall upper plates 24 installed on the anti-fall spring 23. Anti-fall assembly 76 has the function of preventing counterweight box 4 falling and harming the unit base. Additionally, when the counterweight box is permitted to run to anti-fall upper plates 24 it compresses the spring and stores energy. When reversing the spring can release energy to reduce the starting current of motor 11.

Figure 3:
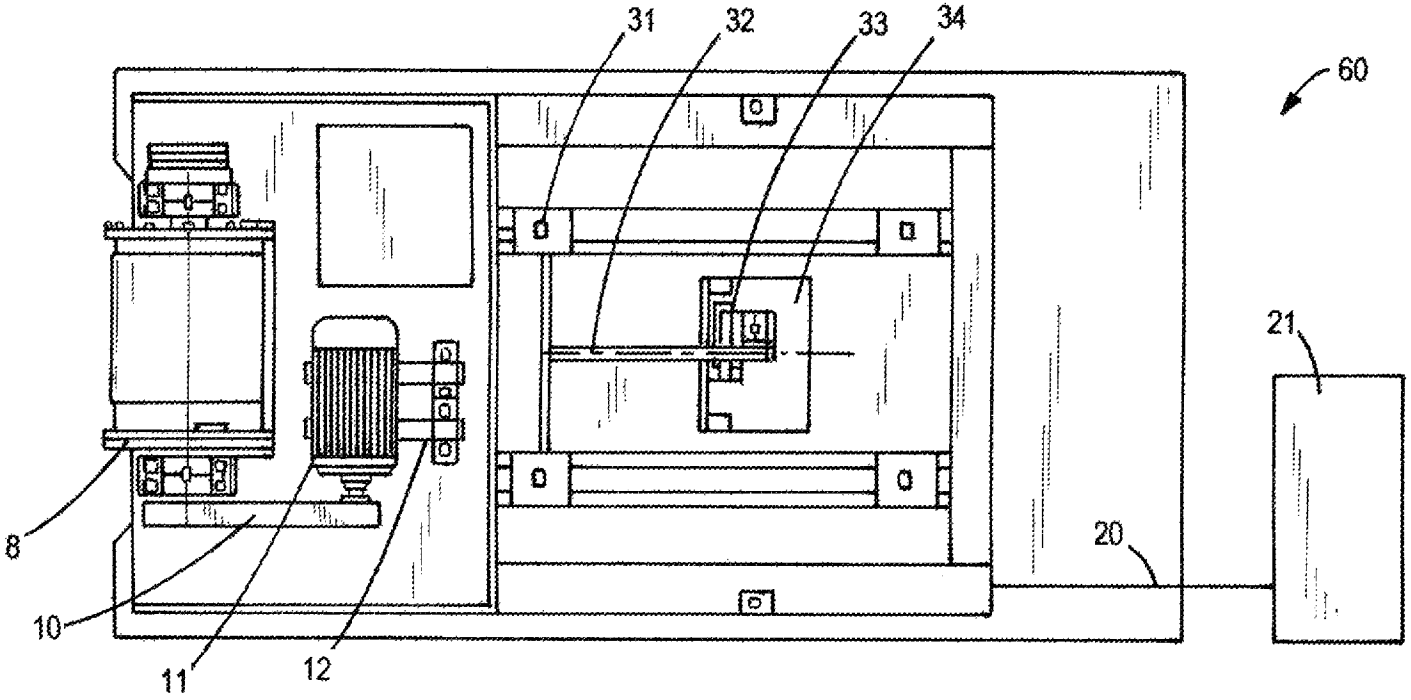
FIG. 3 illustrates a schematic of a top view of the pumping unit of FIG. 1, in accordance with the present disclosure.

FIG. 3 illustrates a structural schematic of a top view of the pumping unit of FIG. 1. Flexible beam deceleration roller cone vertical pumping unit 60 includes deceleration roller cone 8, joint zone 10, motor 11, fixed guide rail 12 for regulating the motor, cable 20, electric control cabinet 21, anchor bolt 31, electric leading screw 32, dynamic assembly of electric leading screw 33, and fixed base of assembly of electric leading screw 34. Deceleration roller cone power driving assembly 72 includes a deceleration roller cone 8 installed in front of the upper platform of the frame assembly. A fixed guide rail for regulating motor 12 whose upside has motor 11 is installed behind deceleration roller cone 8. A calibration zero proximity switch is installed between the deceleration roller cone and the motor. Motor 11 and deceleration roller cone 8 transmit power through joint zone belt 10.

Figure 4:
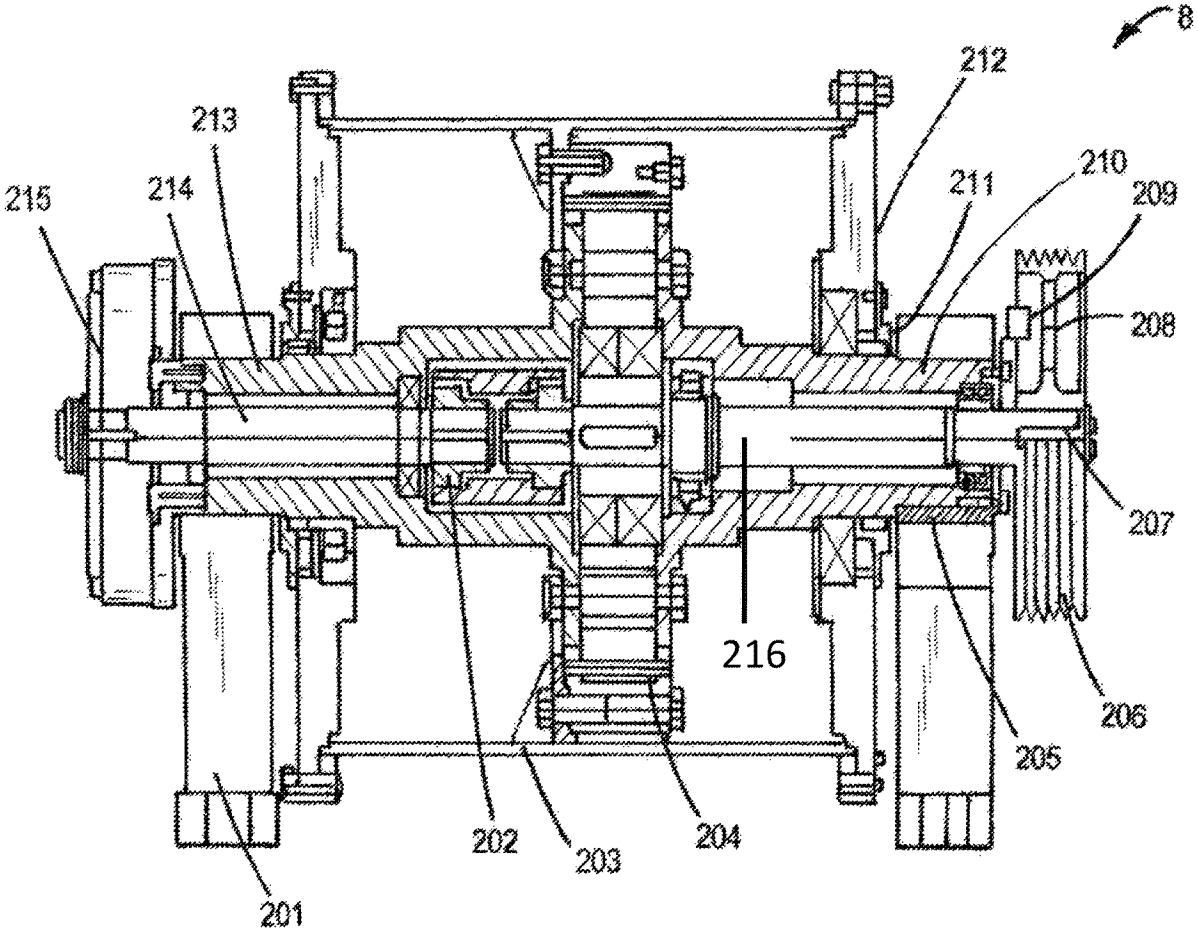
FIG. 4 illustrates an exemplary deceleration roller cone, in accordance with the present disclosure.

FIG. 4 illustrates an exemplary deceleration roller cone. The deceleration roller cone is provided as an exemplary gear reduction unit. A number of gear reduction units are known in the art and the disclosure is not intended to be limited to the deceleration roller cone embodiment provided herein. Deceleration roller cone 8 is illustrated including support base 201, coupling 202, barrel 203, deceleration components 204, bond 205, pulley 206, input axis 207, revolution counting proximity switch 209, revolution signal cavity 208 providing a gap for switch 209 to monitor, right axle shaft 210, oil seal 211, end shield 212, left axle shaft 213, brake axle 214, and power-off brake 215. Input axis 207 is installed coaxially in the right axle shaft 210, the right end of input axis 207 is installed on belt pulley 206, the left is installed on an internal gear of coupling 202, and the rocker bearing of deceleration components 204 is installed on the right side of coupling 202. The illustrated exemplary embodiment includes a cycloid pin wheel reducer as an exemplary construction. Right axle shaft 210 connects to left axle shaft 213 through the pin roll of deceleration components 204. Brake axle 214 is installed coaxially in left axle shaft 213. The rotating wheel of power-off brake 215 is installed on the left end of brake axle 213. The other internal gear of coupling 202 is installed on the right of it. The outer gear of coupling 202 connects two internal gears of input axis 210 and brake axle 216 to link right axle shaft 210 with brake axle 214. The pin gear housing of deceleration components 204 is fixed on barrel 203. Both sides of barrel 203 are installed on end shield 212 through the bolts. Two of end shield 212 are installed on left axle shaft 213 and right axle shaft 210 through the bearings. Two of oil seal 211 are installed on each of the two end shield 212. The fixed seat and the magnetic coil of power-off brake 215 is installed on the left end face of the axle shaft 213. Power-off brake 215 acts as an emergency brake activating when power is lost to prevent uncontrolled motion. Revolution counting proximity switch 209 is installed on the right end face of right axle shaft 210, left axle shaft 213 and right axle shaft 210 is fixed on support base 201 through key 205. Belt pulley 206 is manufactured with revolution signal generation pore 208.

As is shown in FIG. 1, a moving machine and abdicating lifting driving system includes moving cement base 1, base 2, moving machine and abdicating lifting wheels 19, electric leading screw 32, assembly of electric leading screw 33, and fixed base of assembly of electric leading screw 34. Moving machine and abdicating lifting wheels 19 are welded on base 2. Beneath base 2 is moving cement base 1. As shown in FIG. 3, electric leading screw 33 is installed on moving cement base 1. One side of electric leading screw 32 is installed on base 2. The other side of electric leading screw 32 is installed on the dynamic assembly of electric leading screw 33. When a down-hole remedial operation is conducted the system plays a role in hoisting the pumping unit and making it move back and forth to make room for the operation and subsequently to recover the working position.

Figure 5:
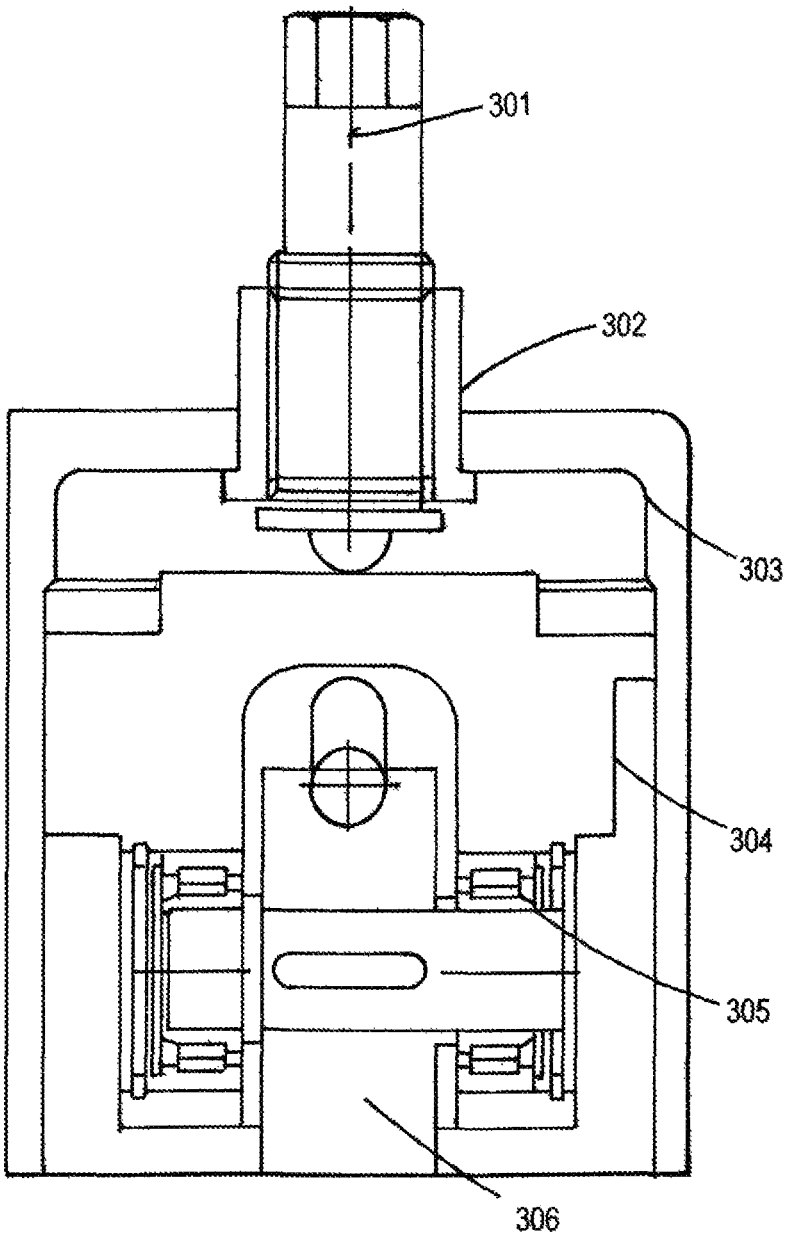
FIG. 5 illustrates an exemplary moving machine and abdicating lifting wheel, in accordance with the present disclosure.

FIG. 5 illustrates an exemplary moving machine and abdicating lifting wheel. Moving machine and abdicating lifting wheel 19 is illustrated in FIG. 5 in detail including lifting screw 301, lifting nut 302, walk round outer stent 303, walk round inner stent 304, walking wheel spindle 305, and walking wheel spindle 306.

Figure 6:
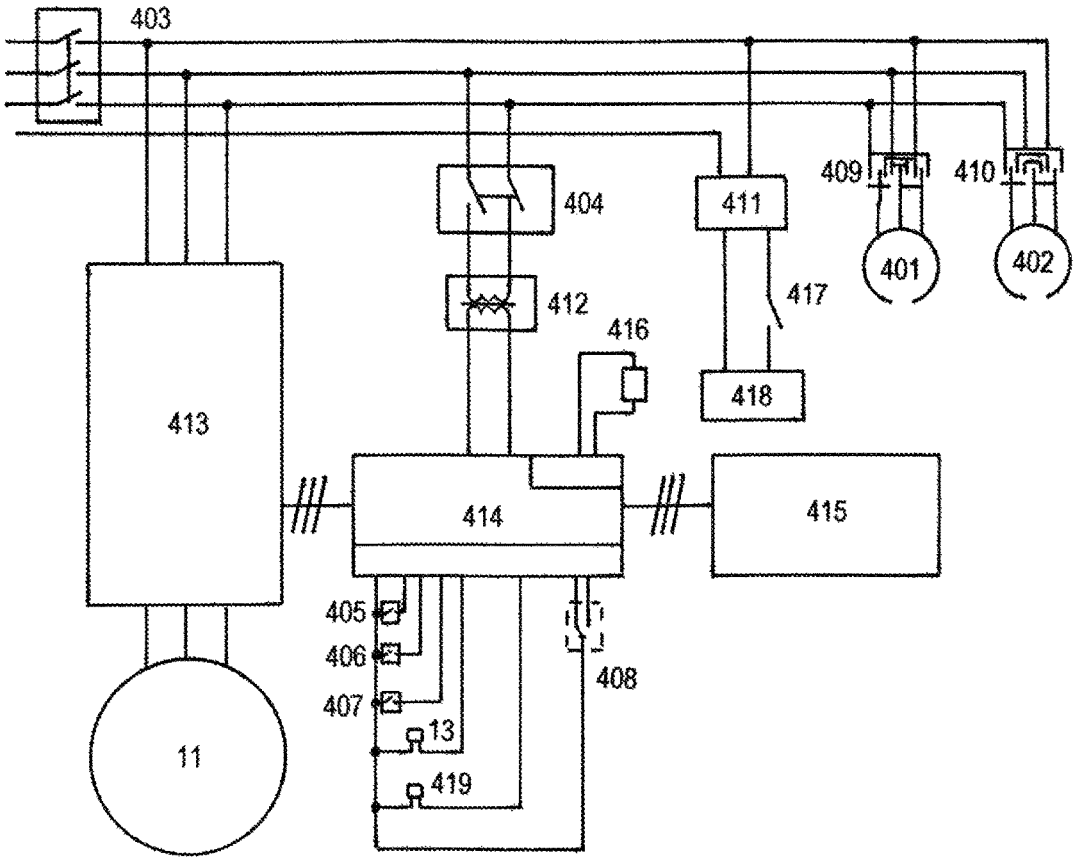
FIG. 6 illustrates an exemplary electronic control block diagram for the disclosed pumping unit, in accordance with the present disclosure.

An exemplary electric-controlling system for the disclosed pumping unit includes electric control cabinet 21, motor 401 of hoisting drum engine 27 of the unloading and hanging-load assembly, motor 402 of the dynamic assembly of electric leading screw 33 of the lifting driving system of moving machine abdicating lifting wheel 19, calibration zero proximity switch 13 between deceleration roller cone 8 and motor 11, power-off brake 15 on deceleration roller cone 8, revolution counting proximity switch 8-9, and cable 20 that connects the electric control cabinet and other kind of electrical components. FIG. 6 illustrates an exemplary electronic control block diagram for the disclosed pumping unit. Exemplary control circuitry is illustrated including power switch 403 of the electric control cabinet, control transformer switch 404, upwards start button 405, downwards start button 406, stop button 407, manual/automatic change-over switch 408, reversible switch 409, reversible switch 410, switching power supply 411, control transformer 412, controller 413, PLC 414, text display 415, relay coil for brake control 416, normally open relay contacts for brake control 417, power-off brake 418, calibration zero proximity switch 13, proximity switch for counting revolutions 419, deceleration roller cone motor or primary motor 11, lifting motor or hoist motor 401, motor of dynamic assembly of electric leading screw 402. Electric control cabinet 403 provides electricity for the system and control transformer switch 404 provides electricity for the control transformer 412. Control transformer 412 provides electricity for PLC 414. Switching power supply 411 provides electricity for power-off brake 215 of FIG. 4. Input control instructions can be provided to PLC 414. Frequency converter 413 inputs real-time running state to PLC 414 and according to the state of inputs, computerized programming of PLC 414 (namely a program editing controller) outputs control signals to command frequency converter 413 to control start-stop, diversions, positive and negative rotation of motor 11, command an on/off state for power-off brake 215, functions of upstream or downstream start, stop, adjust stroke, adjust stroke frequency, stop brake and any other required functions of the pumping unit. Reversible switch 409 provides electricity to motor 401 to complete the positive and negative rotation of the hoisting drum when an unload or load operation is in process in order to raise or put down the counterweight box. Reversible switch 410 provides electricity to motor 402 to complete the positive and negative rotation of electric leading screw motor 402 of the moving machine and abdicating lifting driving system in order to push the pumping unit to the wellhead or drag it from the wellhead location.

Exemplary operation of an embodiment of the pump is provided. Before starting the initial state of the pumping unit the flexible beam is connected to a bare trunk, which is connected to a down-hole (i.e. underground) pump. One then calculates the weight of a sucker rod within the well and the weight/load of the down-hole pump and ground liquid column. The weight in the counterweight box can then be adjusted based upon the calculations. According to one embodiment, the counterweight can be provided with iron weights equal to the weight of the down-hole sucker rod and one half of the weight of the fluid column. The hoist motor can then be engaged to control the position of the counterweight to a desired starting position. The operator can then command parameters and initiation of the pumping operation of the pumping unit.

Exemplary pumping operation is described. At this time counterweight box 4 is under frame 3 and beam hanger 5 is on the upper position of frame 3. Manual/automatic change-over switch 408 of electric control cabinet 21 is set to manual position and the power switch of electric control cabinet 403, control transformer switch 404 are closed in turn at this time. Text display 415 shows the stop state of the system. A worker pressing downstream start button 406 provides an input to PLC 414. PLC 414 provides output signals to command power-off brake 215 to turn on the brake. At the same time frequency converter 413 controls motor 11 to make it move forward. A motor belt wheel drives belt pulley 206 of deceleration roller cone 8 and input axis 207 rotation to rotate through joint zone belt 10. Input axis 207 drives deceleration components 204 to drive barrel 203 to rotate. One end of load leather belt 6 (i.e. flexible balance beam) covered on barrel 203 connects the load of the oil well. The other end of belt 6 connects to counterweight box 4. Friction produced by load leather belt 6 and barrel 203 drags counterweight box 4 up. Calibration zero proximity switch 13 receives a signal through induction and sends out pulse signals to PLC 414 when the calibration zero soft iron 25 on load leather belt 6 reaches the position of calibration zero proximity switch 13. PLC 414 records this position as zero, the motor continues to rotate, and revolution counting proximity switch 209 on deceleration roller cone 8 records the number of revolutions indicated by detection of signal generation pore 208. PLC 414 converts the recorded rotations to positive linear displacement. When the positive linear displacement recorded real-time reaches a threshold positive linear displacement set by PLC 414 the counter-weight box has run to the top of the frame and a down-hole pump runs to the bottom. PLC 414 controls frequency converter 413 to change the phase sequence for motor 11 to make it reverse, and the positive linear displacement as tracked by PLC 414 reverses and begins to decrease. The calibration zero proximity switch 13 receives a signal through induction and sends out pulse signals to PLC 414 when the calibration zero soft iron 25 on load leather belt 6 reaches the position of calibration zero proximity switch 13 again. PLC 414 can record the positive linear displacement value reaching zero at this point. When the a negative displacement value is recorded, by PLC 414, the counter-weight box has run to the bottom of the frame. At this point, anti-fall upper plates 24 and anti-fall spring 25 are displaced and the spring begins to store energy. At the same time, the underground oil well pump has run to the upper floor and is lifting crude oil. PLC 414, control frequency converter 413, and motor 11 adjust phase sequence to a forward direction, and compressed anti-fall spring 25 releases stored energy. Through this release of energy of the anti-fall spring, the starting current of motor 11 accomplishing the reversing is reduced. This reduction in the starting current of motor 11 provides significant energy conservation. This cycle is repeated to complete the pumping of crude oil. Stop button 407 can be depressed to command PLC 414 a shutdown action.

An automatic operation can be commanded through manual/automatic change-over switch 408 of electric control cabinet 21. According to exemplary operation, PLC 414 may extract a last stop position of displacement figures to determine an initial desired direction of travel. Displacement figures and frequency of operation parameters can easily be provided or adjusted through text display 415 providing input to PLC 414.

When workers remove the oil wells load, a first operation can include making the pumping unit move to the bottom of the balance weight tray and frame 3. Load off wire rope 26 can subsequently be connected to hoisting drum 14, and the other end can connected to balance weight tray hoisting lug 17. Workers may close reversible switch 409 to make motor 401 rotate in a forward direction. Hoisting drum 14 rotates to move balance weight tray 4 to the top of frame. The worker may disconnect reversible switch 409 to provide a stop. The worker may then close reversible switch 409 to make motor 401 rotate in forward direction. Beam hanger 5 is connected to the bare trunk. The workers may disengage the beam hanger from bare trunk rope and achieve the oil wells load to take-down. A worker may then close reversible switch 409 to make motor 401 rotate in forward direction causing the balance weight tray move downward into the anti-fall plates. Balance weight tray 4 and beam hanger 5 cycle back and forth based upon sensor activations and control provided by the motor. Workers may remove the bare trunk clip and manually run the pumping unit so that balance weight tray 4 is moved to an up position. Load off wire rope 26 can be made slack. Workers may finally take down load off wire rope 26 and complete dis-lodging load operation.

When a worker needs to cease/remove the pumping unit operations a first step for dis-lodging a load of the oil well is to remove the oil wells load. A worker may then release anchor bolt 31 of the pumping unit, spin down the lifting screw 301 of motion machine abdicate lifting wheel 19 so a gap is formed between pumping unit and motion machine cement base 1. The worker may then close reversible switch 410 to make motor 402 rotate in forward direction. This rotation applies electric leading screw dynamic assembly 33 to move pumping unit leaving the wellhead some distance. Once a desired movement of the unit is achieved the worker may disconnect reversible switch 410 to make motor 402 stop and finally secure anchor bolt 31.

When a worker needs to restore the pumping unit to the wellhead location the worker can release anchor bolt 31 of pumping unit and close the reversible switch 410 to make motor 402 rotate in reverse direction. This rotation returns the pumping unit to the wellhead position. Rotary lifting screw 301 of motion machine abdicate lifting wheel 19 can be activated so pumping unit is secured to motion machine cement base 1 again. The worker may secure anchor bolt 31 to complete the pumping unit abdicate and reset procedures.

The disclosed pumping unit includes a counter balance system including the balance weight tray which is connected by a flexible belt or beam to pumping machinery that are suspended within a well to pump oil from the ground. The disclosed pumping unit, by balancing the weight of the tray with the pumping machinery, can be highly efficient as compared to known pumping units. The weight of the pumping machinery is partially or fully counterbalanced by the tray, and the motor merely has to accelerate the balanced system back and forth through the cyclic pumping action. Further, known systems to suspend pumping machinery can include heavy industrial chains. The present pumping unit is disclosed to include a leather or rubberized belt (e.g. flexible beam) which can easily fold and displace. Such flexibility can be advantageous in an event of uncontrolled pressure buildup in the well. Such an event can violently force the pumping machinery upward and known heavy industrial chains can impact pump structure, motor, or reduction gear and damage the pumping unit. The significant mass of the chain causes it to become a projectile. The leather belt or rubberized belt has significantly less mass than a typical industrial chain and would be less likely to damage the pumping unit. Further, the pumping unit is configured to translate back and forth upon base 2. In one embodiment, in the event of an uncontrolled pressure event such as sensed for example by movement of the pumping machinery, the pumping unit can automatically pull away from the well to prevent pumping unit damage. The unit can further include a kill switch upon the gear reducer or the motor to stop all power to the unit or otherwise secure the unit in case of abnormal feedback from sensors upon the unit. In other embodiments, the system can use a chain, cable, or any other flexible material to constitute the flexible beam.

Sensors upon the unit can include magnetic detection/piezoelectric sensors located upon the flexible beam or tray 4, in combination with features upon the stationary frame 3, such that movement of the pumping machinery can be accurately controlled. With such control the pumping frequency, the pumping stroke, and other factors can be controlled and altered based upon specifics of the well being pumped. Additionally, the system can be scaled to provide a pumping unit with different capacities such as ranging from values at or below 7 tons to at or above 24 tons.

The disclosure has described certain preferred embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. An apparatus comprising a vertical pumping unit for pumping oil from a well, comprising:

a frame being vertically oriented;

a flexible beam connected on a first end to pumping machinery that is suspended within the well to pump the oil from the ground; a motor providing power to move one side of the flexible beam up and down;

a counterweight box connected to a second end of the flexible beam and suspended by the frame, wherein the counterweight box comprises a weight to balance the power machinery, wherein the flexible beam is a load leather belt, one end of the load leather belt is connected with the counterweight box, and the other end of the load leather belt is connected to a connector for pumping the oil from the well;

a hoisting drum attached to an upper portion of the frame and configured to move the counterweight box independently from the motor through a wire rope, wherein the wire rope can be removed to disconnect the hoisting drum with the counterweight box when the apparatus is in normal operation; when an operation for unloading and hanging-load of the well is needed, the wire rope connects the hoist motor with the counterweight box; and wherein the hoist ability of the hoist motor is larger than the weight of the counterweight box; a drum-type deceleration roller cone providing variable gear reduction or changing a ratio of angular velocity of an input shaft that receives toque from the motor to the drum-type deceleration roller cone and driven by the motor directly in a rotatable way, comprising:

a support base;

a coupling;

a belt pulley;

a revolution counting proximity switch;

a revolution signal cavity providing a gap for the revolution counting proximity switch to monitor the number of revolutions of the drum-type deceleration roller cone;

a right axle shaft;

a left axle shaft;

a left brake axle;

a right brake axle; and a power-off brake, wherein the input shaft is installed coaxially in the right axle shaft; the right end of the input shaft is installed on the belt pulley; and the left end of the input shaft is installed on an internal gear of the coupling;

the right axle shaft connects to the left axle shaft indirectly;

the brake axle is installed coaxially in the left axle shaft;

a rotating wheel of the power-off brake is installed on the left end of the brake axle; a magnetic coil of the power-off brake is installed on the left end face of the left axle shaft; and the power-off brake is an emergency brake activating when power is lost to prevent uncontrolled motion;

an internal gear of the coupling is installed on the right of the brake axle; an outer gear of the coupling connects two internal gears of the input shaft and the brake axle to link the right axle shaft with the brake axle;

the revolution counting proximity switch is installed on the right end face of the right axle shaft and records the number of revolutions indicated by detection of a signal generation pore; the left axle shaft and the right axle shaft are fixed on the support base;

a wheel of the motor drives the belt pulley of the drum-type deceleration roller cone and the input shaft to rotate directly through the joint zone belt;

the motor and the drum-type deceleration roller cone are connected by a joint zone belt directly and both the motor and the drum-type deceleration roller cone are installed on the upper platform upon the frame and are located above the counterweight box;

the flexible beam rests upon the drum-type deceleration roller cone forming the outer surface of the drum-type deceleration roller cone; the friction between the flexible beam and the drum-type deceleration roller cone is used to transform circular motions of the drum-type deceleration roller cone into linear motions of the flexible beam; and the power-off brake, the left brake axle, the coupling, the deceleration components, the right brake axle, and the belt pulley are directly connected to each other in a sequential order from left to right;

an anti-fall device installed and oriented inside the frame, wherein the anti-fall device prevents the counterweight box from falling and comprises a spring disposed below the counterweight box; when the anti-fall device runs to an anti-fall upper plate, the anti-fall device translates kinetic energy of the counterweight box into elastic potential energy of the spring, and the kinetic energy is stored in the spring; and when the counterweight box is reversing, the spring translates the elastic potential energy into the kinetic energy of the counterweight box.

2. The apparatus of claim 1, further comprising a control system using field oriented control to control the motor.

3. The apparatus of claim 1, further comprising:

a concrete slab installed to ground below the vertical pumping unit;

a horizontal unit base connected to the frame and sitting upon the slab; and at least one abdicating lifting wheel connected to a bottom of the horizontal unit base and selectively lifting the horizontal unit base from the slab and enabling movement of the vertical pumping unit.

4. The apparatus of claim 3, further comprising a motorized unit configured to retract the vertical pumping unit from the oil well hole when the lifting wheel lifts the horizontal unit base from the slab.

5. The apparatus of claim 4, wherein the anti-fall device is configured to contact the counterweight box at a bottom of travel of the counterweight box and provide a rebound force to the counterweight box.

6. The apparatus of claim 1, further comprising:

a concrete slab installed to ground below the vertical pumping unit;

a horizontal unit base connected to the frame and sitting upon the slab; and at least one abdicating lifting wheel connected to a bottom of the horizontal unit base and selectively lifting the horizontal unit base from the slab and enabling movement of the vertical pumping unit.

7. The apparatus of claim 1, further comprising:

an iron on the flexible beam;

a calibration zero proximity switch installed between the drum-type deceleration roller cone and the motor; and a programmable logic controller (PLC), wherein when the iron reaches the position of the calibration zero proximity switch, the calibration zero proximity switch receives a signal through induction and sends out pulse signals to the PLC, and the PLC records the position of calibration zero proximity switch as a zero position; and the PLC outputs control signals to a command frequency converter to control start-stop, diversions, positive and negative rotation of the motor in accordance with the pulse signals.

* * * * *